United States Patent [19]

Fritsch

[11] 4,035,524

[45] July 12, 1977

[54] PROCESS FOR COATING A PHOSPHOR SLURRY ON THE INNER SURFACE OF A COLOR CATHODE RAY TUBE FACEPLATE

[75] Inventor: Kenneth L. Fritsch, Wheaton, Ill.

[73] Assignee: Zenith Radio Corporation, Glenview, Ill.

[21] Appl. No.: 672,817

[22] Filed: Apr. 1, 1976

[51] Int. Cl.[2] ..... B05D 5/06; B05D 3/12

[52] U.S. Cl. ..... 427/68; 427/72; 427/73; 427/202; 427/231; 427/240; 427/372 R

[58] Field of Search ..... 427/68, 72, 240, 64, 427/157, 202, 299, 73, 372 R

[56] References Cited

U.S. PATENT DOCUMENTS

| | | | |
|---|---|---|---|
| 3,376,153 | 4/1968 | Fiore | 427/68 |
| 3,467,059 | 9/1969 | Kornner | 427/240 |
| 3,712,815 | 1/1973 | Rohrer | 96/36.1 |
| 3,940,508 | 2/1976 | Wilcox | 427/68 |
| 3,966,474 | 6/1976 | Harper | 427/68 |

*Primary Examiner*—Michael F. Esposito
*Attorney, Agent, or Firm*—John R. Garrett

[57] ABSTRACT

This disclosure depicts a process for forming on an inner viewing surface of a color cathode ray tube having a flangeless faceplate a coating of an aqueous slurry composed of a photosensitized organic binder and a suspension of phosphor particles. The process comprises applying an aqueous pre-wet to the inner surface of the faceplate and, while the surface is still wet, applying a phosphor slurry to the pre-wetted inner surface of the faceplate; and suffusing the slurry across the surface to form a coating thereof. As a result of the pre-wetting of the faceplate surface, the occurrence of radially oriented non-coated areas on the surface is eliminated and the phosphor sedimentation rate is enhanced.

21 Claims, 4 Drawing Figures

PROCESS FOR COATING A PHOSPHOR SLURRY ON THE INNER SURFACE OF A COLOR CATHODE RAY TUBE FACEPLATE

CROSS REFERENCE TO RELATED PATENT APPLICATION

This application relates to, but is in no way dependent upon, copending application Ser. No. 592,431, filed July 2, 1975, of common ownership herewith.

BACKGROUND OF THE INVENTION

This invention relates in general to color television cathode ray tubes. Conventionally, a color television cathode ray tube has a glass bulb which is fabricated in two parts; a funnel and a flanged faceplate which is sealed to a flared end of the funnel. Conventional color cathode ray tube faceplates typically comprise a dished viewing portion having a concave inner surface upon which a phosphor screen is deposited. The screen comprises a mosaic of intercalated patterns of red-emissive, blue-emissive and green-emissive phosphor elements. The patterns of elements are deposited in succession, each by a series of operations which includes the application of a coating of an aqueous phosphor slurry to the faceplate inner surface. This invention concerns an improved process for applying such phosphor slurry coatings to the inner viewing surface of a color cathode ray tube faceplate. The phosphor slurries involved typically include a photosensitized organic binder and a suspended particulate phosphor material having a predetermined particle size distribution. The organic binder, typically PVA (polyvinyl alcohol), its sensitizer, and the phosphor material are commonly collectively termed the slurry "solids."

All known methods for disposing phosphor slurry coatings on color cathode ray tube faceplates involve an operation wherein a quantity of phosphor slurry is suffused (spread) across the faceplate surface to be coated. This suffusion operation generally involves the application of a puddle of slurry to the surface to be coated, followed by one or more operations which cause the puddle of slurry to be spread across all areas of the surface. The excess slurry is then removed. Finally, a "levigation" operation is employed by which the suffused coating is leveled and thinned down to a predetermined thickness; typically this is accomplished by very rapidly spinning the faceplate, or in the disclosure of U.S. Pat. No. 3,700,444, by inverting the faceplate.

A number of prior art methods for applying phosphor slurry coatings have been developed. The commercially most common methods involve applying a puddle of slurry onto the concave inner surface of a faceplate while the faceplate is in a face-down position. The puddle is then suffused across the surface to be coated by tilting and rotating the panel to cause the puddle to move across all areas of the entire surface to be coated, or alternatively, by spinning the panel to cause the puddle to spread by centrifugal force across the faceplate inner surface. For example, see RCA Review, Vol. 16, pp. 122–139 (March, 1955) and U.S. Pat. Nos. 2,902,973; 3,319,759; 3,376,153; 3,364,054; 3,467,059; and 3,700,444.

Conventional faceplates have a rearwardly extending flange which contains the puddle. This invention is applicable to such conventional faceplates and color cathode ray tube faceplates in general, but is perhaps especially suited for use with a color cathode ray tube faceplate having a dished viewing portion but no flange. The tilt-type process is not applicable to a flangeless faceplate, since such a faceplate has no flange to retain the slurry on the faceplate during the tilting and rotation of the faceplate. Without the flange the slurry would flow over the edge of the faceplate before the coating operation is completed.

The afore-described prior art methods, in general, involve a coating leveling or levigation process in which the faceplate is spun at high speeds to thin down and level the coatings of phosphor slurry which have been suffused across the faceplate inner surface. By the nature of the puddling-type processes, a relatively thick layer of phosphor slurry is deposited upon the faceplate surface. In order to thin down this thick layer to an acceptable coating thickness, the panel is spun at a high speed (e.g., 250–300 RPM) for a relatively long interval, e.g., 10–15 seconds.

It is known in the commercial manufacture of black grilles for color cathode ray tubes of the black matrix type to apply a uniform layer of a graphite material to the inner surface of a color cathode ray tube faceplate by flowing a graphite solution onto the faceplate while it is being rotated in a substantially vertical attitude. Such a process is disclosed in U.S. Pat. No. 3,652,323. A similar process is used earlier in the grill-making operation to apply a photosensitized PVA coating under the graphite layer. The graphite and PVA coating processes have little or no relevance, however, to the invention described and claimed herein.

The reference copending application Ser. No. 592,431 discloses a non-settling process for forming on an inner viewing surface of a color cathode ray tube faceplate, a coating of an aqueous slurry composed of an organic binder and a suspension of particulate phosphor material of distributed particle size. The process comprises supporting the faceplate such that the axis of the faceplate has a substantial horizontal component, and slowly rotating the faceplate about the central axis thereof while dispensing a stream of phosphor slurry having a predetermined phosphor particle size distribution onto the central region of the faceplate inner surface, preferably, substantially at the axis of rotation. Due to gravitational forces and the slow rotation of the faceplate through the descending slurry stream, the slurry is suffused to the perimeter of the faceplate inner surface without any significant settling out of the phosphor particles onto the faceplate. The coating is then levigated by rotating the coated faceplate at a moderate angular velocity for a brief time interval, the joint effect of which moderate angular velocity and brief time interval being to level the coating down to a predetermined thickness while suppressing the formation of radial streaks in the coating.

That process has been found effective to apply a uniform slurry coating, however, in spite of its relatively high through-put rate, even higher rates are desirable.

OBJECTS OF THE INVENTION

It is a general object of this invention to provide an improved process for forming a phosphor slurry coating on an inner viewing surface of a color cathode ray tube faceplate.

It is yet another object of this invention to provide a process for applying phosphor slurry coatings to color cathode ray tube faceplates which is relatively rapid and thus which effects economies in the manufacture of color cathode ray tubes.

BRIEF DESCRIPTION OF THE DRAWINGS

The features of the present invention which are believed to be novel are set forth with particularly in the appended claims. The invention, together with further objects and advantages thereof, may best be understood by reference to the following description taken in conjunction with the accompanying drawings, in which:

DESCRIPTION OF THE PREFERRED EMBODIMENT

This invention concerns a process for forming a coating of phosphor slurry on the inner viewing surface of a color cathode ray tube faceplate. In the manufacture of color cathode ray tubes as known today, it is necessary to form on the inner surface of the transparent viewing window, commonly termed the faceplate, a phosphor screen in the form of a mosaic of intercalated red-emissive, blue-emissive and green-emissive phosphor elements. Conventionally, this mosaic of phosphor elements is made by depositing a first pattern of phosphor elements (typically green-emissive), followed by deposition of a second pattern of phosphor elements (typically blue-emissive) in the open areas between the green-emissive phosphor elements, and finally be depositing in the remaining space a third pattern of phosphor elements (typically red-emissive).

Each of these afore-described patterns of phosphor elements are made by first forming a coating of phosphor slurry over the faceplate inner surface. This slurry is typically an aqueous composition including an organic binder such as PVA (polyvinyl alcohol) which has been photosensitized, as for example, with ammonium dichromate, in which is suspended a particulate phosphor material of distributed particle size. This coating is exposed through a stencil and developed, leaving on the surface a pattern of phosphor elements. These deposition, exposure and development operations are repeated twice more to form the mosaic of three intercalated patterns of phorphor elements emissive of red, blue and green light.

Today's color cathode ray tubes are almost universally of the negative guardband, black surround type, a taught by U.S. Pat. No. 3,146,368, which include a "black grille." A black grille is a layer of light-absorptive material having a pattern of openings, one at every location of a phorphor element, into which openings the phosphor elements are deposited. The black grille provides enhanced contrast in the reproduced CRT images by absorbing ambient room light falling on the screen. In tubes of the type having a black grille, the grille is conventionally deposited on the inner surface of the faceplate before the patterns of phosphor elements are deposited. As will be explained, this invention involves the use of a spin-coating process for applying phosphor slurry to the inner surface of a faceplate.

Figure 1:
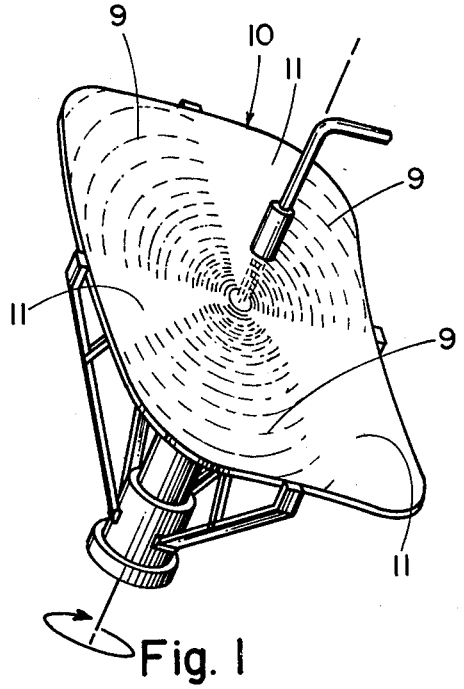
FIG. 1 is a perspective view showing an apparatus used in applying a slurry to the inner surface of a faceplate of a cathode ray tube, indicating "preferred regions" on the faceplate sought out by the slurry in a spin-type process.

In the use of a spin process for forming the coatings of phosphor slurry on the inner surface of a faceplate, it is frequently observed (see FIG. 1) that the slurry will flow outward across a faceplate 10 in certain slurry-preferred regions 9 rather than evenly across the entire surface, creating radially oriented non-coated areas. Once the certain slurry-preferred regions 9 are established, even the application of additional slurry will not cause coverage of the non-coated areas 11. The process of this invention overcomes this problem and effects efficiency and economy in the screening of color cathode ray tube faceplates.

In its most general terms, the process of this invention comprises applying to the inner surface of the faceplate an aqueous pre-wet and, while the surface is still wet, applying a phosphor slurry to the pre-wetted surface and suffusing the slurry across the pre-wetted inner surface to form a coating thereon. As a result of pre-wetting the inner surface of the faceplate, the occurrence of radially oriented non-coated areas is eliminated and the phosphor sedimentation rate is enhanced. As noted above, these coatings may be placed either on the bare inner surface of a faceplate, or, in tubes of the type having a black grille, over the black grille. Prior to each application of a phosphor slurry, corresponding to the green, blue and red slurries the inner surface is pre-wetted.

In a preferred execution of the invention, the process of this invention involves supporting the faceplate to be coated, such that the central axis of the faceplate has a substantial horizontal component. The faceplate is then slowly rotated about its central axis, while a stream of aqueous pre-wet is dispensed onto the central region of the faceplate inner surface. A ¼% PVA (polyvinyl alcohol) in water solution is preferred in wetting the inner surface. Because of the substantially vertical attitude of the faceplate, the solution flows by gravity down across the faceplate. The slow rotation of the faceplate through the descending solution stream causes the solution to suffuse to the perimeter across all areas of the faceplate inner surface. This wetting of the inner surface of the faceplate is extremely significant and forms an important aspect of this invention as will be described in more detail hereinafter.

The faceplate is now supported such that the plane of the faceplate has a substantial horizontal component, that is, the central axis of the faceplate is substantially vertical. The faceplate is rotated at a moderate angular velocity about its central axis and a stream of phosphor slurry is dispensed onto the central region of the inner surface. Due to centrifical forces, the slurry is suffused to the perimeter of the faceplate inner surface and, due to the pre-wetting of the faceplate, the slurry will evenly coat the inner surface and not form preferred regions 9 as discussed above (schematically illustrated in FIG. 1).

The slurry coating on the inner surface is levigated by rotating the coated faceplate at a high angular velocity for a predetermined brief time interval. The joint effect of the high angular velocity and brief time interval is to level the coating down to a predetermined thickness. Finally, the faceplate is rotated at a low angular velocity for a moderate period of time to dry the slurry. This prevents the formation of slurry build-up at the perimeter of the faceplate or at the center of the inner surface. If the faceplate is not rotated and is held in a substantially vertical position, before it has sufficient time to dry, the slurry will tend to flow down, due to gravity, and build up on the downwardly position side of the faceplate and thin out at the top of the faceplate. Conversely, if the slurry is allowed to dry while the faceplate is in a substantially horizontal position without rotating, the slurry will tend to flow to the center of the inner surface since the faceplate inner surface is concave.

Figure 2:
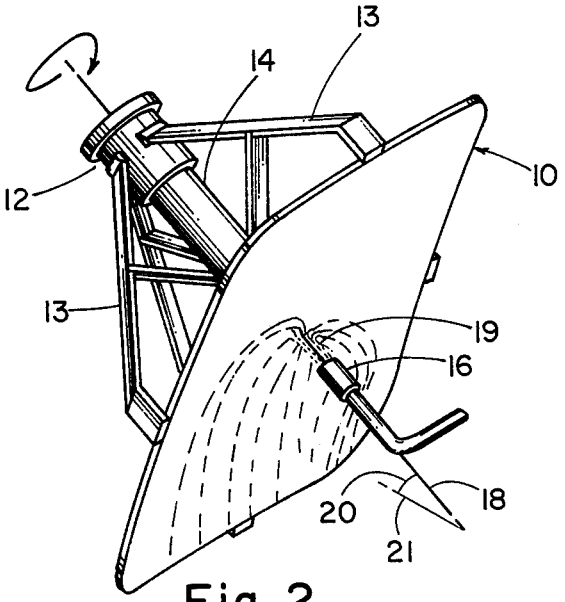
FIGS. 2–4 are perspective views of apparatus which may be employed to apply phosphor slurry coating according to the process of this invention on faceplates of a flangeless character.
Figure 3:
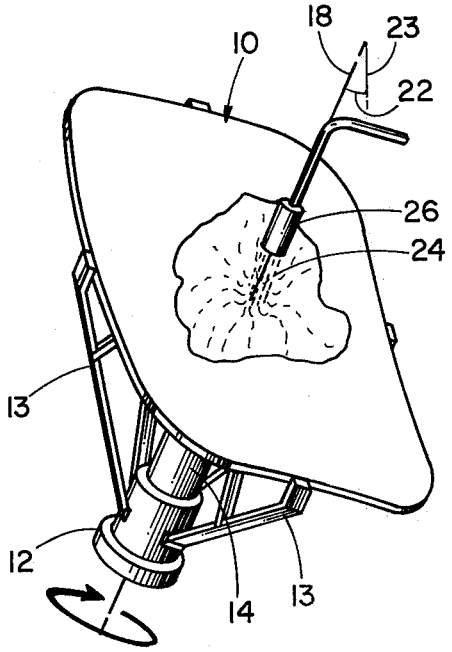
Figure 4:
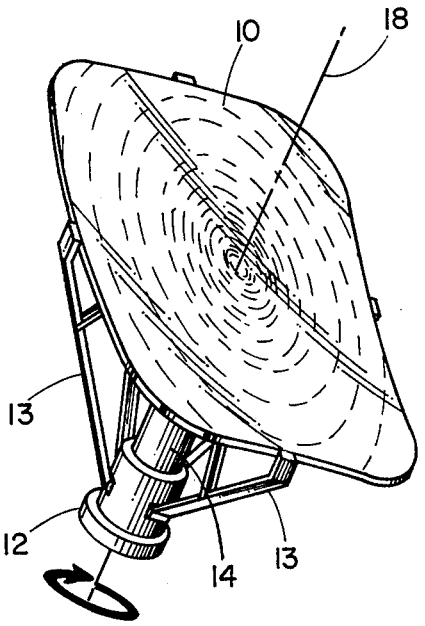

The various operations involved in the process of this invention will now be described in much more detail and are schematically illustrated in FIGS. 2–4. The first step of the process described above is the supporting of the faceplate such that plane of the faceplate has a substantial vertical component, as shown in FIG. 2. As noted above, whereas this invention has general applicability to the coating of a phosphor slurry on color cathode ray tube faceplates of various types, it is perhaps especially useful for coating faceplates which do not have a rearwardly extending flange. Such a flangeless faceplate is shown at 10 in FIG. 2. FIG. 2 also shows support means 12 for supporting the faceplate 10, a driven shaft 14 for supporting and rotating the support means 12 and faceplate 10, and a nozzle 16 from which the aqueous pre-wet is dispensed onto the center of faceplate 10.

The support means 12 is illustrated as taking the form of plurality of arms 13 which hold faceplate 10 securely for rotation, preferably about its central axis 18. (Various other methods could be used to couple the faceplate 10 to the shaft 14.) Shaft 14 may be rotated by direct or indirect coupling to a drive motor (not shown).

Initially, the faceplate 10 may be rotated at an angular velocity in the range of about 30 to 60 revolutions per minute. A dilute (e.g. ¼%) PVA in water solution is then applied to the faceplate 10 through the nozzle 16 at a predetermined flow rate. A stream of solution 19 issuing from the nozzle 14 is preferably directed so as to hit the faceplate 10 at approximately the axis of rotation of the faceplate 10. The faceplate 10 is supported such that the central axis 18 of the faceplate 10 makes an angel 20 of approximately 30° with a horizontal reference line 21. The angle 20 is not critical, and the faceplate 10 could assume a strictly vertical position wherein the angle of the central axis is essentially zero or, the faceplate may be tilted until angle 20 is as much as 40°. The time interval for dispensing the solution may be in the range of about 5 to 10 seconds. Preferably, the solution is directed at the faceplate 10 for about 6 seconds, while the faceplate 10 is rotated at approximately 50 revolutions per minute.

After the faceplate 10 has been pre-wetted it is moved to the position shown in FIG. 3 so that it is substantially horizontal. In the preferred embodiment the faceplate 10 is positioned so that its central axis 18 makes an angle 22 of about 25° with a vertical reference line 23. A range of 15° to 30°, however, is acceptable. (The faceplate preferably will remain at this angular position during the remaining steps of the process.)

The faceplate rotation is increased to a moderate angular velocity which may be in the range of about 100 to 150 revolutions per minute (preferably, 120 revolutions per minute). At this angular velocity a stream of slurry 24 is applied to the inner surface of the faceplate 10 through a slurry nozzle 26 at a predetermined flow rate. The stream 24 issuing from the slurry nozzle 26 is preferably directed so as to hit the faceplate 10 at approximately the axis of rotation of the faceplate 10 (also the central axis 18 of the faceplate 10). The impinging stream 24 should be sufficiently limp as to not cause the formation of bubbles in the slurry. The nozzle 26 should be purged prior to each dispensation operation or run continuously to avoid the dispensation of slurry in which phosphor has settled out in the nozzle 26. This arrangement of nozzle 26 and slurry stream 24 has been found to produce the most uniform phosphor slurry coating. Due to centrifical forces, the slurry is suffused to the perimeter of the faceplate inner surface. Rotational speeds somewhat higher or lower than the range indicated above may be employed but are not found to be preferred.

The slurry dispense interval may last in a range of about 3 to 6 seconds (preferably about 4 seconds), during which time as a result of the angular rotation of the faceplate, the phosphor slurry is suffused to the perimeter of the faceplate.

It is an important aspect of this invention that due to the pre-wetting of the inner surface of the faceplate, the slurry as it spreads out across the faceplate during the moderate angular rotation does not tend to seek certain preferred regions as pointed out above. Surprisingly, the slurry will tend to evenly distribute itself across the pre-wetted inner surface, thus greatly increasing the efficiency of coating the faceplate.

Another important advantage of pre-wetting the inner surface of the faceplate prior to coating it with the slurry, is that once the slurry has suffused across the faceplate the solution tends to thin the slurry and permit the suspended phosphor particles to settle out. Thus a heavy coating of phosphor is achieved in less time than if a dry faceplate is used. A high through-put rate is a very important goal in the mass production of color cathode ray tubes.

In order to provide a thin, level phosphor slurry coating of a predetermined thickness, the faceplate is rotated at a high angular velocity in the range of about 225 to 300 revolutions per minute (see FIG. 4). Although it is possible to perform the process of this invention at rotational speeds during levigation of 300 revolutions per minute, or perhaps even higher, it is preferable to operate at about 225 revolutions per minute. The levigation interval is very brief, for example, about 3 to 10 seconds (preferably, about 7 seconds).

Finally, the faceplate 10 is rotated at a low angular velocity which may be in the range of about 30 to 60 revolutions per minute (preferably, about 40 revolutions per second) for approximately 30 seconds to allow time for the slurry on the inner surface of the faceplate to dry sufficiently to immobilize the slurry coating. As pointed out above, by rotating the faceplate during the drying period, the slurry is prevented from settling onto the center of the inner surface and also from building up at the perimeter of the faceplate. A drying period in the range 15 to 30 seconds is sufficient.

The process of this invention is used for the application of each of the three phosphor slurries applied to the inner surface of the faceplate which eventually form the pattern of green-emissive, blue-emissive and red-emissive phosphor elements.

The invention is not limited to the particular details of the process depicted and other modifications and applications are contemplated. Certain changes and latitudes, other than those mentioned above, may be made in the above-described method without departing from the true spirit and scope of the invention herein involved. For example, to achieve the important pre-wetting of the faceplate, the faceplate may be dipped in a pre-wet bath, deionized water could be used instead of the ¼% PVA in water solution, or the faceplate could be held in a stationary position while aqueous pre-wet is sprayed over its entire inner surface. Pre-wet solutions of other compositions may be employed; or a PVA-water pre-wet may be used with a different PVA concentration. It is intended, therefore, that the subject matter in the above depiction shall be interpreted as illustrative and not in a limiting sense.

What is claimed is:

1. A process for forming on an inner viewing surface of a color cathode ray tube having a flangeless faceplate a coating of an aqueous slurry composed of a photosensitized organic binder and a suspension of phosphor particles, said process comprising:

applying an aqueous pre-wet to the inner surface of the faceplate;

while said surface is still wet, applying a phosphor slurry to the pre-wetted inner surface of the faceplate; and suffusing said slurry across said surface to form a coating thereon, whereby as a result of said pre-wetting of said faceplate surface, the occurrence of radially oriented non-coated areas on said surface is eliminated and the phosphor sedimentation rate is enhanced.

2. The process defined in claim 1, wherein wetting the inner surface of the faceplate comprises supporting the faceplate such that a central axis of the faceplate has a substantial horizontal component, and slowly rotating the faceplate about its central axis while dispensing a stream of aqueous pre-wet onto a central region of the faceplate inner surface such that, due to gravitational forces and the slow rotation of the faceplate through the descending aqueous pre-wet stream, the aqueous pre-wet is suffused to the perimeter of the faceplate inner surface, thus wetting the entire area of the inner surface.

3. The process defined in claim 2, wherein said applying of a phosphor slurry to the pre-wetted inner surface of the faceplate comprises supporting the faceplate such that a central axis of the faceplate has a substantial vertical component and rotating the faceplate about its central axis at a moderate angular velocity while dispensing a stream of phosphor slurry onto the central region of the pre-wetted faceplate inner surface such that, due to centrifugal forces, the slurry is suffused to the perimeter of the faceplate inner surface.

4. The process defined by claim 3 wherein, after the application of the phosphor slurry, the phosphor slurry is levigated.

5. The process defined by claim 2 wherein said aqueous pre-wet is a ¼% PVA in water solution.

6. A process for forming on an inner viewing surface of a flangeless faceplate in a color cathode ray tube a coating of an aqueous slurry composed of a photosensitized organic binder and a suspension of phosphor particles, said process comprising:

applying an aqueous pre-wet to the inner surface of the faceplate; and supporting the faceplate such that a central axis of the faceplate has a substantial vertical component and rotating the faceplate about its central axis at a moderate angular velocity; and while said surface is still wet, dispensing a stream of phosphor slurry onto the central region of the pre-wetted faceplate inner surface; and suffusing said slurry to the perimeter of the faceplate inner surface to form a coating thereon, whereby as a result of said pre-wetting of said faceplate surface, the occurence of radially oriented non-coated areas on said surface is eliminated and the phosphor sedimentation rate is enhanced.

7. The process defined by claim 6 wherein the angular velocity of said faceplate during the application of the aqueous pre-wet is in the range of about 30 to 60 revolutions per minute and the dispense interval is in the range of about 5 to 10 seconds.

8. The process defined by claim 6 wherein the angular velocity of said faceplate during the slurry dispensation is in the range of about 100 to 150 revolutions per minute and the dispense interval is in the range of about 3 to 6 seconds.

9. The process defined by claim 6 wherein an angle formed by said central axis of said faceplate and the horizontal during the application of the aqueous pre-wet solution is in the range of about 0° to 40°.

10. The process defined by claim 6 wherein an angle formed by said central axis of said faceplate and the vertical during the slurry dispensation is in the range of about 15° 30°.

11. A process for forming on an inner viewing surface of a color cathode ray tube having a flangeless faceplate a coating of an aqueous slurry composed of a photosensitized organic binder and a suspension of phosphor particles, said process comprising:

supporting the faceplate such that a central axis of the faceplate has a substantially horizontal component;

slowly rotating the faceplate about its central axis while dispensing a stream of ¼% PVA (poly vinyl alcohol) in water solution onto a central region of the faceplate inner surface such that, due to gravitational forces and the slow rotation of the faceplate through the descending solution stream, the solution is suffused to the perimeter of the faceplate inner surface, thus wetting the entire area of the inner surface;

supporting the faceplate such that a central axis of the faceplate has a substantial vertical component; and while said surface is still wet, rotating the faceplate about its central axis while dispensing a stream of phosphor slurry onto the central region of the pre-wetted faceplate inner surface such that the slurry is suffused to the perimeter of the faceplate inner surface, whereby as a result of said pre-wetting of said faceplate surface, the occurrence of radially oriented non-coated areas on said surface is eliminated and the phosphor sedimentation rate is enhanced.

12. The process defined by claim 11 wherein, after the slurry dispensation, the phosphor slurry on the faceplate is levigated by rotating the coated faceplate about its central axis at a predetermined relatively high angular velocity for a predetermined brief time interval.

13. A process for forming on an inner viewing surface of a color cathode ray tube having a flangeless faceplate a coating of an aqueous slurry composed of a photosensitized organic binder and a suspension of phosphor particles, said process comprising:

supporting the faceplate such that a central axis of the faceplate has a substantial horizontal component;

slowly rotating the faceplate about its central axis while dispensing a stream of dilute PVA (poly vinyl alcohol) in water solution onto a central region of the faceplate inner surface such that, due to gravitational forces and the slow rotation of the faceplate through the descending solution stream, the solution is suffused to the perimeter of the faceplate inner surface, thus wetting the entire area of the inner surface;

supporting the faceplate such that a central axis of the faceplate has a substantial vetical component;

while said surface is still wet, rotating the faceplate about its central axis at a predetermined relatively moderate angular velocity while dispensing a stream of phosphor slurry onto the central region of the pre-wetted faceplate inner surface such that, due to centrifugal forces, the slurry is suffused to the perimeter of the faceplate inner surface; and levigating the phosphor slurry by rotating the coated faceplate about its central axis at a predetermined relatively high angular velocity for a predetermined brief time interval, the joint effect of which high velocity and brief time interval being to level and thin down the slurry to a predetermined thickness, whereby as a result of said pre-wetting of said faceplate surface, the occurrence of radially oriented non-coated areas on said surface is eliminated and the phosphor sedimentation rate is enhanced.

14. The process as defined in claim 13 wherein, after levigating the phosphor slurry on the faceplate, the faceplate is rotated about its central axis at a predetermined relatively low angular velocity for a moderate period of time to immobilize and dry the slurry, thereby preventing the formation of slurry buildup at the perimeter of the faceplate or at the center of the faceplate.

15. The process defined by claim 14 wherein the angular velocity of said faceplate during the drying operation is in the range of about 30 to 60 revolutions per minute and the time interval is in the range of about 15 to 30 seconds.

16. The process defined by claim 13 wherein the angular velocity of said faceplate during the solution dispensation is in the range of about 30 to 60 revolutions per minute and the dispense interval is in the range of about 5 to 10 seconds.

17. The process defined by claim 13 wherein the angular velocity of said faceplate during the slurry dispensation is in the range of about 100 to 150 revolutions per minute and the dispense interval is in the range of about 3 to 6 seconds.

18. The process defined by claim 13 wherein the angular velocity of said faceplate during the levigation operation is in the range of about 225 to 300 revolutions per minute and the time interval is in the range of about 3 to 10 seconds.

19. The process defined by claim 13 wherein an angle formed by said central axis of said faceplate and the horizontal during the solution dispensatin is in the range of about 0° to 40°.

20. The process defined by claim 13 wherein an angle formed by said central axis of said faceplate and the vertical during the slurry dispensation, during levigation, and during the drying operation, is in the range of about 15° to 30°.

21. A process for forming on an inner viewing surface of a color cathode ray tube having a flangeless faceplate a coating of an aqueous slurry composed of a photosensitized organic binder and a suspension of phosphor particles, said process comprising:

supporting the faceplate such that a central axis of the faceplate forms an angle with the horizontal of approximately 30°;

slowly rotating the faceplate about its central axis at an angular velocity of approximately 50 revolutions per minute while dispensing a stream of ¼% PVA (poly vinyl alcohol) in water solution onto a central region of the faceplate inner surface for a dispense interval of approximately 6 seconds such that, due to gravitational forces and the slow rotation of the faceplate through the descending solution stream, the solution is suffused to the perimeter of the faceplate inner surface, thus wetting the entire area of the inner surface;

supporting the faceplate such that a central axis of the faceplate forms an angle with the vertical of approximately 25°;

while said surface is still wet, rotating the faceplate about its central axis at an angular velocity of approximately 120 revolutions per minute while dispensing a stream of phosphor slurry onto the central region of the pre-wetted inner surface of the faceplate for a dispense interval of approximately 4 seconds such that, due to centrifugal forces, the slurry is suffused to the perimeter of the faceplate inner surface;

legivating the phosphor slurry by rotating the coated faceplate about its central axis at an angular velocity of approximately 225 revolutions per minute for a time interval of approximately 7 seconds, the joint effect of which angular velocity and time interval being to level and thin down the slurry to a predetermined thickness;

rotating the faceplate at an angular velocity of approximately 40 revolutions per minute for a period of time of approximately 30 seconds to dry the slurry, thereby preventing the formation of slurry buildup at the perimeter of the faceplate or at the center of the faceplate, whereby as a result of said pre-wetting of said faceplate surface, the occurrence of radially oriented non-coated areas on said surface is eliminated and the phosphor sedimentation rate is enhanced.

* * * * *